United States Patent [19]

Reinehr et al.

[11] Patent Number: 4,718,257

[45] Date of Patent: Jan. 12, 1988

[54] PROCESS AND AN APPARATUS FOR CONDITIONING SYNTHETIC FIBER MATERIAL

[75] Inventors: Ulrich Reinehr; Rolf-Burkhard Hirsch; Wolfram Wagner, all of Dormagen; Erich Hilgeroth, Remscheid, all of Fed. Rep. of Germany

[73] Assignee: Bayer Aktiengesellschaft, Leverkusen, Fed. Rep. of Germany

[21] Appl. No.: 921,798

[22] Filed: Oct. 17, 1986

Related U.S. Application Data

[63] Continuation of Ser. No. 729,589, May 2, 1985, abandoned.

[30] Foreign Application Priority Data

May 22, 1984 [DE] Fed. Rep. of Germany ..... 3418942

[51] Int. Cl.[4] ..... D06B 3/10

[52] U.S. Cl. ..... 68/5 E; 68/5 D

[56] References Cited

U.S. PATENT DOCUMENTS

| | | | |
|---|---|---|---|
| 3,045,461 | 7/1962 | Saito | 68/5 E |
| 3,320,022 | 5/1965 | Hill | 68/5 D X |
| 3,365,752 | 1/1968 | Farell | 68/20 |
| 3,908,410 | 9/1975 | Umehara et al. | 68/5 D X |
| 3,945,225 | 3/1976 | McCoy | 68/5 D |
| 4,052,796 | 10/1977 | Arendt | 68/20 X |
| 4,121,311 | 10/1978 | Meyer | 68/5 D X |
| 4,345,385 | 8/1982 | Sando et al. | 68/5 D X |

FOREIGN PATENT DOCUMENTS

| | | | |
|---|---|---|---|
| 2060941 | 10/1972 | Fed. Rep. of Germany | 68/5 D |

*Primary Examiner*—Harvey C. Hornsby
*Assistant Examiner*—Frankie L. Stinson
*Attorney, Agent, or Firm*—Sprung Horn Kramer & Woods

[57] ABSTRACT

The conditioning of synthetic fiber material to produce perfect products with a low residual solvent content using comparatively small quantities of steam is carried out in a steam-tight conditioning apparatus consisting of several zones with a rotating perforated belt, using steam which has been superheated to temperatures of from 105° to 150° C., and the material having a residence time in the apparatus of more than 3 minutes.

2 Claims, 3 Drawing Figures

PROCESS AND AN APPARATUS FOR CONDITIONING SYNTHETIC FIBER MATERIAL

This application is a continuation of application Ser. No. 729,589, filed 5-2-85.

BACKGROUND OF THE INVENTION

This invention relates to a process, and to an apparatus, for conditioning cables or webs consisting of synthetic fibres by means of steam, more particularly filaments and fibres of acrylonitrile polymers with at least 40% by weight of acrylonitrile units, optionally after crimping.

Perforated drum steamers and perforated belt steamers are preferably used as apparatus for steaming continuously conveyed synthetic fibre material (e.g. in DE-OS No. 2 060 941 or GB-PS No. 1 208 792). Steam tubes, steam tunnels and U-shaped steam cylinders, c.f. e.g. Textilpraxis international December 1981, page 1410 or Chemiefasern/Textilindustrie November 1981, page 821 or February 1982, page 96, have also become known. Combinations of crimping apparatus with connecting fixation chambers (e.g. U.S. Pat. No. 2,865,080) are also described in various forms and embodiments, particularly for texturising and fixing processes. These steam aggregates are used for drying and shrinking fibre cables and for stabilising the crimping and spin dying of the fibres.

In EP-OS No. 98 477 is described firstly a continuously-operating dry spinning process for acrylonitrile filaments and fibres, in which the tow of 100,000 dtex or more is prepared, shortly before or directly after leaving the spinning shafts, is then stretched, crimped and fixed, without the cable contacting a liquid for extracting the spinning solvent, for example, water. Most of the spinning solvent is expelled in the spinning shafts in this process. The solvent content of the filaments on leaving the spinning shafts is generally less than 10% by weight, based on the fiber solids content, but more than 1% by weight.

Known conditioning apparatus are not suitable for this process. The required quantities of steam are either too high or else damage to the natural tone, or felting, of the fibre cable occurs.

SUMMARY OF THE INVENTION

An object of the present invention is to provide a suitable conditioning apparatus for the continuous dry spinning process, in which apparatus a connected crimping process can be integrated. An object of the conditioning apparatus is therefore to stabilize the crimping, reduce the shrinkage caused by the stretching process and to remove the residual quantity of spinning solvent. The process and apparatus should be suitable for conditioning cables and webs.

The object is achieved, in that, in a steam-tight conditioning apparatus, the synthetic fiber material, on a rotating perforated belt, is subjected to steam which has been superheated in at least two stages to a temperature of from 105° to 150° C. and has a residence time in the conditioning device of more than 3 minutes.

An object of the present invention is thus a process for conditioning synthetic fiber material, more particularly synthetic fiber cables or webs, characterized in that, in a steam-tight conditioning apparatus the synthetic fiber material, on a rotating perforated belt is, subjected to steam which has been superheated in at least two stages to a temperature of from 105° to 150° C. and has a residence time of more than 3 minutes in the conditioning apparatus.

By the term "steam-tight" is to be understood that the uncontrolled steam losses, from the inlet and outlet of the synthetic fiber material together, amount to less than 1%. If a crimping apparatus is integrated in a completely steam-tight manner into the conditioning apparatus, the inlet into the crimper serves as the inlet for the synthetic fiber material. Compression chambers and blast crimpers are preferred for this.

The superheated steam is suitably passed in countercurrent to the fiber material and repeatedly supplied to the fiber material in the individual stages of treatment by means of ventilators. The superheated steam is preferably generated in the conditioning apparatus, into which saturated steam enters, which is superheated by means of heat exchangers.

The temperature of the superheated steam is preferably from 120° to 140° C., the residence time preferably from 5 to 15 minutes. The process operates efficiently when the perforated belt is covered with a density of up to 15 kg/m$^2$, preferably up to 10 kg/m$^2$. The covering density can easily be calculated from the coverable surface of the perforated belt, the residence time and the throughput (kg/h).

The process is particularly suitable for conditioning tows consisting of acrylic fibers with at least 40% by weight of acrylonitrile units, preferably at least 85% by weight of acrylonitrile units, which are obtained after a continuous dry spinning process, during the course of which they do not contact a liquid for extracting the spinning solvent.

During the conditioning thereof, stable crimping, according to the present process, with a steam consumption of less than 1 kg per kg of fiber material carried through the apparatus according to the invention a residual solvent content of less than 1% by weight and an acrylic fiber which does not shrink during boiling are produced.

A further object of the invention is a conditioning apparatus, in which the process according to the invention can be carried out. The conditioning apparatus is shown in FIGS. 1 to 3.

DETAILED DESCRIPTION OF THE INVENTION

The apparatus according to the invention consists of a perforated belt steamer which is sealed in a steam-tight manner and is divided into several zones A to D, the individual zones being separated from each other, zones B and C optionally occuring more than once, and zone A having an inlet device and a suction device for solvent-charged steam, zone B having a ventilator, a heat exchanger and a suction device for solvent-charged steam, zone C having a ventilator, a heat exchanger and a steam supply device and Zone D having a suction device for solvent-charged steam.

A zone E is optionally connected, in which the synthetic fiber material is cooled, before it is supplied for further use, for storage, for packaging or for cutting.

Figure 1:
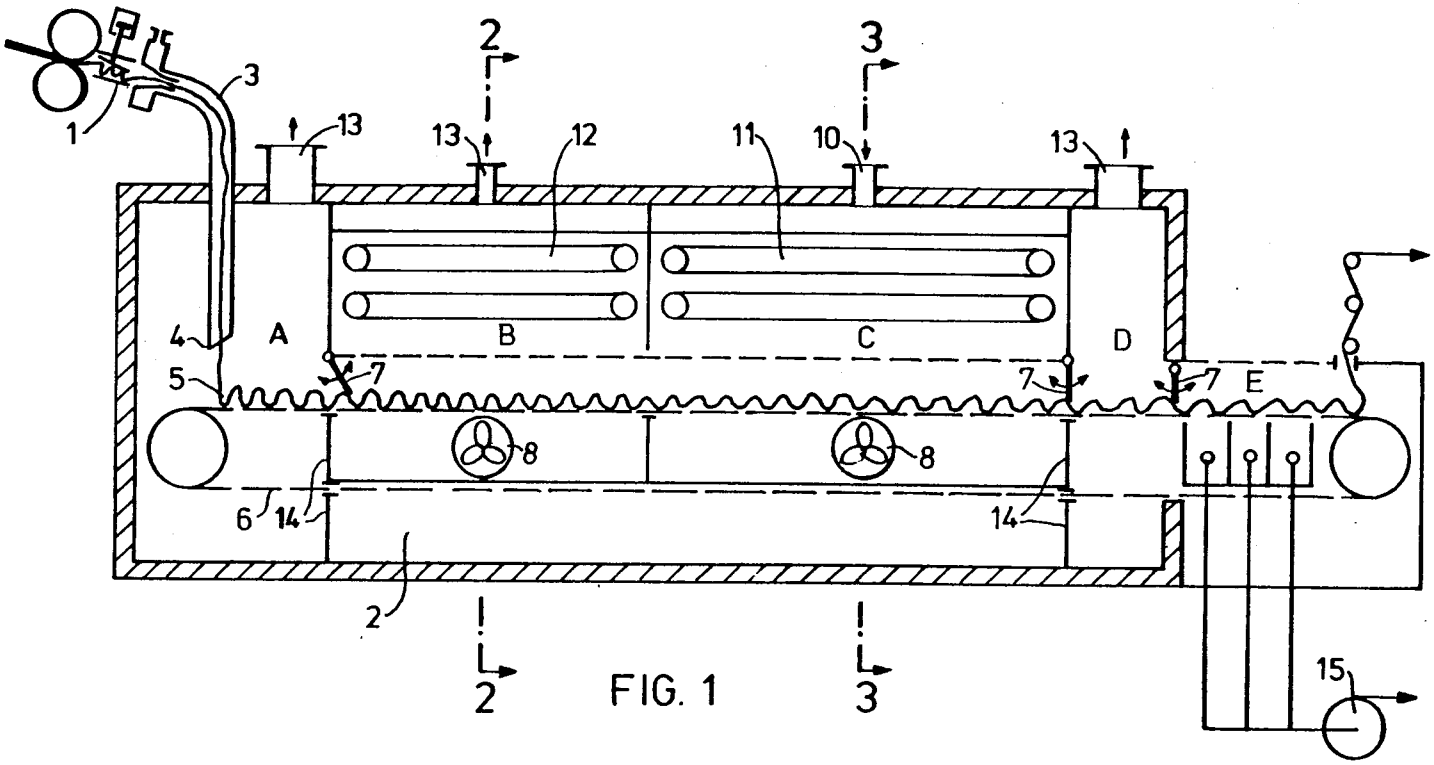
FIG. 1 shows a longitudinal section through the apparatus.

In FIG. 1, a compression chamber crimper (1) is integrated in the conditioning apparatus (2). The crimped fiber cable (5) is folded onto a conveyor belt (6), for example a meshed or perforated belt, via the sealed channel (3) and a traversing device (4). After passing through the inlet zone (A), in which there is no forced circulation of the steam, the folded fiber cable reaches the steam zones (B) and (C) via the sealing flap (7). The two steam zones are separated from each other by guide plates and are provided with circulation ventilators (8). The live steam is simultaneously passed into the steam zone (C) at (10) via a heat exchanger (11), so that the temperature of the steam is at least 105° C. The process steam flows through the folded fiber cable and is then drawn off by suction by means of ventilators (8), is reheated via the heat exchanger (11) and passed again through the fiber cable. A partial flow of the steam in the steam zone (C) passes into the steam zone (B) in the opposite direction to that of the fiber cable. The steam is then passed again via ventilators (8), via heat exchangers (12) and through the fiber cable, and a partial flow charged with residual spinning solvent is circulated out via the suction device (13). Belt seals in the form of oblique sealing flaps (7), at the height of the folded fiber cable, and strips (14) for sealing the rotating perforated belt (6) substantially prevent steam from escaping. The quantity of steam which nevertheless escapes via the sealing flaps (7) and the sealing strips (14) is carried away in the inlet zone (A) and the outlet zone (D) via suction devices (13), which are provided with adjustable regulating flaps, not shown in the Figure. The folded fiber cable is then passed through a cooling zone (E). Air at room temperature is blasted through the cooling zone by means of a ventilator (15). The fiber cable is then passed to a cutting device and further processed to produce staple fibers or is folded into cartons as continuous tape.

Figure 2:
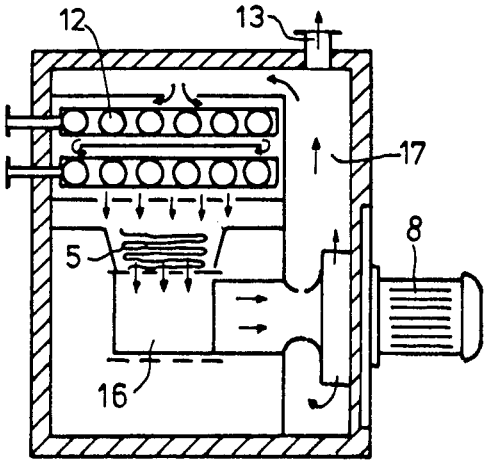
FIG. 2 shows a cross-section through the apparatus in the region of the steam zone B.
Figure 3:
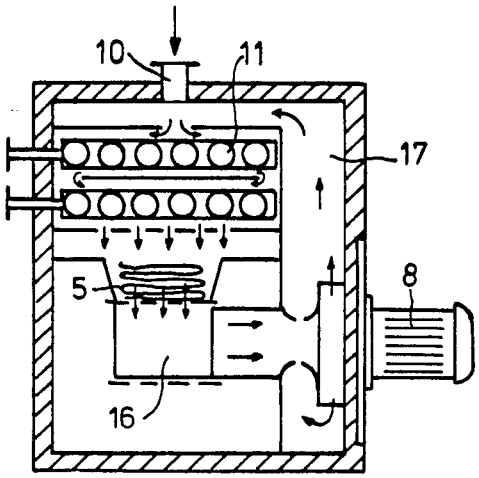
FIG. 3 shows a cross-section through the apparatus in the region of the steam zone C.

FIG. 2 and FIG. 3 show the path of the process steam through the conditioning apparatus by means of cross-sections through the steam zones (B) and (C). The live steam which passes into the steam zone (C) via the inlet (10), flows through the heat exchanger (11) and undergoes superheating. The steam then flows through the folded fiber cable (5), and is returned to the heat exchanger, for renewed circulation, by means of ventilators (8) via a suction channel (16) and a pressure channel (17). A partial current of the steam passes from the steam zone (C) into the circulated quantity of steam in the steam zone (B), where the steam is circulated as in the steam zone (C), is reheated via the heat exchanger (12) and circulated out as a partial flow via the suction device (13).

In a further embodiment of the invention, a crimping process can be connected to the conditioning process.

The direct coupling of the crimping and conditioning apparatus has proved extremely advantageous for the continuous production of fibres. In a particularly preferred case, a compression chamber (1) is directly connected via a sealed channel (3), according to FIG. 1, to the conditioning apparatus. In addition to a compression chamber, the use of a blast pipe crimper, which is analogously coupled with the conditioning apparatus, has proved very favorable, particularly at high production speeds.

EXAMPLE 1

A 30% by weight spinning solution of an acrylonitrile copolymer consisting of 93.6% of acrylonitrile, 5.7% of methyl acrylate and 0.7% of sodium methallylsulphonate, with a K value of 81 (Fikentscher, Cellulosechemie 13, (1932), page 58) in dimethyl formamide, is dry spun from 1264-orifice nozzles with a nozzle orifice diameter of 0.2 mm, at a drawing speed of 60 m/min, on a 20-shaft spinning apparatus. The residence time of the spinning filaments in the spinning shafts is 4 seconds. The shaft temperature is 210° C. and the air temperature is 380° C. The quantity of air passed through is 40 $m^3/h$ for each shaft, and is blasted in at the head of the shaft longitudinally towards the filaments.

The spinning bulk with a total titre of 267,000 dtex, having a residual solvent content of 9.3% by weight, based on the solids material content, is wetted immediately before leaving the spinning shafts with a, from 80° to 90° C., warm, aqueous, oil-containing, anti-static preparation, such that the oil content of the filaments is 0.25% by weight, the anti-static agent content is 0.06% by weight and the moisture content is 1.2% by weight, based on the solids material content. The preparation is metered via gear pumps. The warm cable is then passed over a pair of rollers, which have been inductively heated to a temperature of 150° C., a contact time of about 2 seconds being achieved by repeated winding over a filler roller. The cable thereby assumes a tow temperature of 112° C., measured with the radiation thermometer KT 15 (Manufacturer: Heimann GmbH, Wiesbaden, FRG). The cable is stretched by 450%, a series of 7 stretching devices with coolable rollers acting as the second clamping point. The tow temperature after the stretching process is 61° C. The cable is then immediately mechanically crimped in a compression chamber (1), which is connected to the conditioning apparatus (2) by a sealed channel (3) and, via a traversing device (4), is folded onto a continuously-rotating perforated belt (6). The crimping speed is 270 m/min. After passing through the inlet zone (A), the folded, crimped fiber cable reaches the steam zones (B) and (C), which are 1 m in length and 0.4 m in width. The two steam zones are separated from each other by guide plates and are provided with circulation ventilators (8). Live steam, the quantity of which is regulated by a valve, simultaneously reaches the steam zone (C) via the steam inlet (10), in counter-current to the direction of the fiber cable. The quantity of steam fed in is 48 kg/h at a calculated fiber cable throughput of 96.1 kg/h so that a specific steam consumption of 0.5 kg of steam per kg of fiber cable is set. The live steam which has been fed in and the circulated steam, which is heated to 135° C. via heat exchangers (11) or (12), flows through the folded, crimped fiber cable and a partial flow, which reaches the steam zone (B), is then drawn off, by suction, by ventilators (8) via a suction channel (16) and a pressure channel (17), is reheated by heat exchangers and is again passed over the fibre cable. A partial flow, charged with the residual spinning solvent dimethyl formamide, is circulated out from the steam zone (B) at the steam outlet (13) and is supplied to a distillation column. Belt seals in the form of oblique sealing flaps (7) at the level of the folded fiber cable and sealing strips (14) at the level of the rotating perforated belt substantially prevent the unnecessary escape of steam. Smaller quantities of steam, which reach the inlet zone (A) and the outlet zone (D), are also circulated out from the zones and supplied to the distillation column at this point. The residence time of the folded fiber cable in the steam zones (B+C) of the conditioning apparatus is 5.0 minutes. A specific covering density of about 10 kg/m$^2$ can be calculated from this. The fiber cable is passed via a cooling zone (E) 1.5 m in length, after leaving the conditioning device, in order to stabilize the crimping. Air at room temperature is blasted through the cooling zone by means of a ventilator (15). The fiber cable ready-shrunk to completion is then cut to staple fibers, 60 mm in length, blasted and supplied to a packing press. The acrylic fibers produced in this manner in a continuous process are shrink-proof and have an individual fiber titre of 3.3 dtex. The fiber strength is 2.9 cN/dtex and the elongation is 39%. The residual solvent content of the spinning fiber is 0.62% by weight.

solvent content of 10% by weight, to clearly reduce the residual solvent content to less than 1% by weight, based on the fiber cable, at a residence time of about 5 minutes. All the fibers are again shrink-proof. With higher solvent contents in the fiber cable, lower residual solvent contents are likewise obtained, by correspondingly increasing the quantity of steam and the residence time in the conditioning apparatus. The tests also show that good processing in the secondary spinning mill is only guaranteed if there are no undissolved cut strips in the fiber cable as a result of tape rigidity in the fiber cable. This tape rigidity, by which is to be understood the partial caking or bonding of several crimped individual capillaries to produce a compressed crimped bundle, is always avoided when the residual solvent content in the fiber cable is less than 2% by weight.

TABLE

| No | Steamer temperature °C. | steam quantity kg per kg of cable | residence time min. | covering density kg/m$^2$ | residual solvent content % by weight: spinning bulk | residual solvent content % by weight: after conditioning | make-up of tow | run in the secondary spinning mill |
|---|---|---|---|---|---|---|---|---|
| 1 | 110/112 | 0.5 | 5 | 10 | 9.3 | 0.92 | in order | in order |
| 2 | " | 1 | 5 | 10 | 9.3 | 0.81 | " | " |
| 3 | 135/137 | 0.5 | 3 | 6 | 9.3 | 1.89 | preliminary tow rigidity | partial undissolved cut strips |
| 4 | " | 0.5 | 7.5 | 15 | 9.3 | 0.38 | in order | in order |
| 5 | " | 1 | 3 | 6 | 9.3 | 1.41 | " | " |
| 6 | " | 0.5 | 4 | 8 | 9.3 | 1.13 | " | " |
| 7 | " | 0.5 | 5 | 10 | 7.0 | 0.42 | " | " |
| 8 | " | 0.5 | 5 | 10 | 4.5 | 0.22 | " | " |
| 9 | 135/137 | 1.5 | 7.5 | 15 | 12.7 | 0.93 | " | " |
| 10 | " | 1.5 | 7.5 | 15 | 18.9 | 1.22 | " | " |
| 11 | 148/150 | 0.5 | 5 | 10 | 9.3 | 0.53 | preliminary damage to natural tone | " |
| 12 | 100/102 | 0.5 | 5 | 10 | 9.3 | 3.24 | caking | undissolved cut strips |
| 13 | " | 0.5 | 7.5 | 15 | 9.3 | 2.77 | " | " |
| 14 | " | 1 | 5 | 10 | 9.3 | 1.76 | preliminary tow rigidity | partial undissolved cut strips |
| 15 | " | 1 | 7.5 | 15 | 9.3 | 1.52 | in order | in order |
| 16 | " | 1.5 | 7.5 | 15 | 9.3 | 1.15 | " | " |
| 17 | " | 1 | 5 | 10 | 7.0 | 1.62 | " | " |
| 18 | " | 1 | 5 | 10 | 4.5 | 0.88 | " | " |

The yarns, produced from the fibers on a high-performance carder at 120 m/min, have a yarn fineness of 278 dtex, a yarn strength of 15.3 RKM, an elongation of 18.9% and a yarn shrinkage under boiling of 2.4%.

In the following Table, the make-up and the run in the secondary spinning mill are assessed for tow with the same total titre of 267.000 dtex, which contains a varying residual solvent content of dimethyl formamide and passes through the conditioning apparatus under different steam conditions. The varying residual solvent contents in the fiber cable are achieved by varying the temperature and amount of spinning under otherwise identical test conditions to Example 1. The temperature of the steamer, the quantity of steam passed through per kg of fiber cable and the residence time in the conditioning apparatus are varied.

The Table shows, that superheated steam at a temperature of up to 140° C., is substantially more suitable for removing residual solvent from the fiber cable than saturated steam under otherwise identical conditions. The lower the residual solvent content of the fiber cable before conditioning, the lower will be, naturally, the residual solvent content in the fiber cable after passing through the conditioning apparatus under otherwise identical conditions. The Table also shows, that a quantity of steam of less than 1 kg per kg of fiber cable is generally completely sufficient, with fiber cables with a

EXAMPLE 2

Part of the fiber cable according to Example 1, is supplied, after stretching, to a blast nozzle in place of a compression chamber, the blast nozzle also being connected to the conditioning apparatus by a sealed channel (3). In a modification of FIG. 1, the blast crimper, which is operated by steam which has been superheated to 140° C., is positioned in front of the conditioning apparatus, such that the blast nozzle outlet opening and the connecting channel leads into the conditioning apparatus without being bent. All other conditions correspond to those of Example 1. The acrylic fibers produced in this manner in a continuous process have an individual fiber titre of 3.3 dtex. The fibre strength is 2.8 cN/dtex and the elongation is 33%. The residual solvent content of the tow is 0.58% by weight. The fibers are again shrink-proof. Yarns produced from the fibres on a high-performance carder at 140 m/min have a yarn fineness of 283 dtex, a yarn strength of 16.1 RKm, an elongation of 18.4% and a yarn shrinkage under boiling of 2.4%.

EXAMPLE 3

Part of the fiber cable from Example 1 is cut in a compression chamber, after crimping, with a rotor cutter into staple fiber, 60 mm in length, and supplied to the conditioning apparatus via a feed roller. The other conditions again correspond to those of Example 1. At the end of the cooling zone (E), the fiber web is blasted via a funnel-shaped suction device by means of a ventilator and is supplied to a packing press. Individual fibre titre 3.3 dtex; fibre strength 2.5 cN/dtex; elongation 34%. The residual solvent content of the tow is 0.43% by weight. Again no fiber shrinkage under boiling is observed. Yarn values: yarn strength 15.8 Rkm at a yarn fineness of 290 dtex; elongation 18.1%; yarn shrinkage under boiling 2.7%; carding speed 120 m/min.

We claim:

1. An apparatus for conditioning continuously dry spun synthetic fibers with at least 40% by weight of acrylonitrile units, comprising: a perforated belt steamer sealed in a steam-tight manner and having at least zones A to D separated from each other and a single perforated belt for conveying crimped fiber through zones A, B, C and D in that order, wherein zone A has a fiber inlet device sealed with a sealing flap and a suction device for drawing solvent-charged steam from zone B, wherein there is at least one zone B disposed upstream of zone C in the conveying direction of the fiber and each has a ventilator for circulating the steam within the zone, a heat exchanger for superheating steam; a suction device for drawing solvent-charged steam from zone C counter current to the conveying direction of the fiber material, zone C has a ventilator for circulating the steam within the zone, a heat exchanger for superheating steam and a steam supply inlet device for receiving steam, wherein guide pltes separate zones B and C from each other and zone D has a suction device for drawing solvent-charged steam from zone C and fiber inlet and outlet sealed with sealing flaps.

2. An apparatus according to claim 1, further comprising a crimping device integrated in a steam-tight manner in the conditioning apparatus and a cooling zone E connected to the conditioning apparatus.

* * * * *